US009718587B2

(12) United States Patent
Harada et al.

(10) Patent No.: US 9,718,587 B2
(45) Date of Patent: Aug. 1, 2017

(54) SYNTHETIC RESIN CAP, SYNTHETIC RESIN CAP LINER, CLOSING DEVICE, AND BEVERAGE-CONTAINED CLOSING DEVICE

(71) Applicant: Closure Systems International Japan, Limited, Tokyo (JP)

(72) Inventors: Mitsuharu Harada, Tsukuba (JP); Masataka Hisano, Oyama (JP); Akiko Ogino, Koga (JP)

(73) Assignee: CLOSURE SYSTEMS INTERNATIONAL JAPAN, LIMITED, Tokyo (JP)

( * ) Notice: Subject to any disclaimer, the term of this patent is extended or adjusted under 35 U.S.C. 154(b) by 0 days.

(21) Appl. No.: 14/368,632

(22) PCT Filed: Dec. 14, 2012

(86) PCT No.: PCT/JP2012/082484

§ 371 (c)(1),
(2) Date: Jun. 25, 2014

(87) PCT Pub. No.: WO2013/099655

PCT Pub. Date: Jul. 4, 2013

(65) Prior Publication Data

US 2015/0008223 A1 Jan. 8, 2015

(30) Foreign Application Priority Data

Dec. 27, 2011 (JP) ..... 2011-285164

(51) Int. Cl.
*B65D 41/04* (2006.01)
*B65D 53/04* (2006.01)
*B65D 41/34* (2006.01)

(52) U.S. Cl.
CPC ..... *B65D 41/0428* (2013.01); *B65D 41/3442* (2013.01); *B65D 53/04* (2013.01)

(58) Field of Classification Search
CPC ..... B65D 41/0435; B65D 41/0428; B65D 41/3442; B65D 53/04
(Continued)

(56) References Cited

U.S. PATENT DOCUMENTS 3,371,809 A 3/1968 Pompa
4,463,863 A 8/1984 Imagawa et al.
(Continued)

FOREIGN PATENT DOCUMENTS

BE 852384 A 7/1977
EP 0132992 A 2/1985
(Continued)

OTHER PUBLICATIONS

International Search Report mailed Mar. 12, 2013 for the corresponding PCT Application No. PCT/JP2012/082484.
(Continued)

*Primary Examiner* — James N Smalley
(74) *Attorney, Agent, or Firm* — Leason Ellis LLP

(57) ABSTRACT

A synthetic resin cap comprises: a cap body having a top plate and a cylinder that is vertically lowered from the peripheral edge thereof; and a liner provided on a lower surface of the top plate. The liner has a flat plate; an inter-seal projection that contacts an inner-edge side of an opening end and has an outer-seal projection that contacts an outer-edge side of the opening end. An outer edge of the liner is spaced apart from the cylinder at an internal side and is formed to ensure a space between the outer edge and the cylinder. The outer diameter of the outer-seal projection is smaller than an outer diameter of the opening end.

9 Claims, 6 Drawing Sheets

(58) Field of Classification Search
USPC ..... 215/349, 341, 343, 328, 350, 351
See application file for complete search history.

(56) References Cited

U.S. PATENT DOCUMENTS

| | | | | |
|---|---|---|---|---|
| 6,202,872 | B1 * | 3/2001 | Smeyak et al. | 215/343 |
| 6,478,174 | B1 * | 11/2002 | Grazia et al. | 215/320 |
| 6,533,136 | B1 | 3/2003 | Willingham | |
| 7,147,118 | B2 * | 12/2006 | Bloom et al. | 215/276 |
| 7,588,155 | B2 * | 9/2009 | Williams | 215/343 |
| 7,611,026 | B1 * | 11/2009 | Bloom et al. | 215/276 |
| 2002/0162818 | A1 * | 11/2002 | Williams | 215/343 |
| 2004/0069739 | A1 * | 4/2004 | Zumbuhl | 215/349 |
| 2004/0108294 | A1 * | 6/2004 | Bloom et al. | 215/276 |
| 2004/0155007 | A1 * | 8/2004 | Hearld et al. | 215/343 |
| 2005/0029219 | A1 * | 2/2005 | Taber et al. | 215/349 |
| 2005/0252878 | A1 | 11/2005 | Babcock | |
| 2006/0138073 | A1 * | 6/2006 | Ooka et al. | 215/344 |
| 2006/0163191 | A1 * | 7/2006 | Laveault et al. | 215/343 |

FOREIGN PATENT DOCUMENTS

| | | | |
|---|---|---|---|
| EP | 1760003 | A | 3/2007 |
| JP | 54-092839 | U | 6/1979 |
| JP | 55-051793 | B | 12/1980 |
| JP | 60-183352 | A | 9/1985 |
| JP | 11-208693 | A | 8/1999 |
| JP | 2009-113833 | A | 5/2009 |

OTHER PUBLICATIONS

European Search Report mailed May 19, 2015 for the corresponding European Application No. 12861824.6.

* cited by examiner

SYNTHETIC RESIN CAP, SYNTHETIC RESIN CAP LINER, CLOSING DEVICE, AND BEVERAGE-CONTAINED CLOSING DEVICE

CROSS-REFERENCE TO RELATED APPLICATION

This is the U.S. National Phase Application under 35 U.S.C. §371 of International Patent Application No. PCT/JP2012/082484 filed Dec. 14, 2012, which designated the United States and was published in a language other than English, which claims the benefit of Japanese Patent Application No. 2011-285164 filed on Dec. 27, 2011, both of which are incorporated by reference in their entirety herein. The International Application was published in Japanese on Jul. 4, 2013 as WO2013/099655 A1 under PCT Article 21(2).

FIELD OF THE INVENTION

The present invention relates to a synthetic resin cap for closing a container mouth, a synthetic resin cap liner, a closing device using the synthetic resin cap, and a beverage-contained closing device.

DESCRIPTION OF THE RELATED ART

A synthetic resin cap (hereinbelow, simply referred to as a cap) is known which has: a cap body that is constituted of a top plate and a cylinder that is vertically lowered from the peripheral edge thereof; a liner that is provided on a lower surface of a top plate and made of a soft resin; and a thread that is formed on the inner surface of the cylinder and fits into a male screw of a container mouth (for example, refer to Japanese Unexamined Patent Application, First Publication No. 2009-113833).

FIG. 5 shows an example of a cap, and this cap 31 is provided with a cap body 4 that includes a disk-shaped top plate 2 and a cylinder 3 that is vertically lowered from the peripheral edge thereof, and a substantially disk-shaped liner 35 provided on the lower surface of the top plate 2.

An inter-seal projection 42, that contacts an inner edge of an opening end 21A of a mouth 21 of a container 20, is formed on a lower surface of the liner 35.

FIG. 6 shows another example of a cap, and this cap 51 is provided with a cap body 4 that includes a disk-shaped top plate 2 and a cylinder 3 that is vertically lowered from the peripheral edge thereof, and a substantially disk-shaped liner 55 provided on the lower surface of the top plate 2.

On a lower surface of the liner 55, an inter-seal projection 62 that contacts an inner edge of an opening end 21A of a mouth 21 of a container 20 and an outer-seal projection 63 that contacts an outer edge of the opening end 21A.

The outer-seal projection 63 is formed to reach the cylinder 3.

When a container is filled with a content fluid, generally, attachment of a cap thereto is carried out in a state where a container is filled with a content fluid having a high temperature such as 80° C. or more, that is, a so-called hot packaging is used.

Additionally, in order to enhance a sterilization effect, after the cap attachment is carried out, heating up of the container and the cap by use of a high-temperature water is also carried out.

When such operation is performed, it is necessary to prevent a sealing performance from being degraded which is due to that, the container is subjected to a high temperature, the mouth is deformed by heat shrinkage or the like (for example, inward or outward bending deformation of the opening end), and the adhesiveness between the container mouth and the cap thereby becomes insufficient.

In addition, even in cases where filling is not carried out at a high temperature, it is necessary to prevent the sealing performance from being affected which is due to variation in adhesiveness between the cap and the mouth due to variations in sizes of the mouth (internal diameter, outer diameter, or the like).

SUMMARY OF THE INVENTION

The invention was conceived in view of the above-described circumstances and has an object thereof to provide a cap capable of preventing a sealing performance from being degraded, a liner used for a cap, a closing device, and a beverage-contained closing device.

The invention provides a synthetic resin cap to be attached to a mouth of a container, including: a cap body having a top plate and a cylinder that is vertically lowered from a peripheral edge thereof; and a liner provided on a lower surface of the top plate, the liner having: a flat plate; an inter-seal projection that is formed on a lower surface of the flat plate and contacts an inner-edge side of an opening end of the mouth; and an outer-seal projection that is formed on the lower surface of the flat plate and contacts an outer-edge side of an opening end of the mouth, the liner having an outer edge that is separated from the cylinder in an internal side and is formed to ensure a space between the outer edge and the cylinder, the outer-seal projection having an outer diameter smaller than an outer diameter of the opening end.

In the invention, it is preferable that an outer edge of the outer-seal projection be formed to reach an outer edge of the flat plate.

It is preferable that an outer face of the outer-seal projection be formed on the same plane as an edge surface of an outer edge of the flat plate.

It is preferable that the outer-seal projection have an inner surface to be in contact with the opening end and the inner surface be an inclined surface that lowers according to a direction in which a diameter gradually increases.

It is preferable that an intermediate contact portion that is located along the lower surface of the top plate be formed on the liner and between the inter-seal projection and the outer-seal projection and the intermediate contact portion be capable of contacting an opening edge surface of the opening end.

It is preferable that a cleaning-water introduction hole for introducing a cleaning water into the cap body be formed at the cylinder.

The invention provides a liner provided on a lower surface of a top plate of a synthetic resin cap, the synthetic resin cap comprising a cap body having the top plate and a cylinder that is vertically lowered from a peripheral edge thereof, the synthetic resin cap being attached to a mouth of a container. The liner has; a flat plate; an inter-seal projection that is formed on a lower surface of the flat plate and contacts an inner-edge side of an opening end of the mouth; and an outer-seal projection that is formed on the lower surface of the flat plate and contacts an outer-edge side of an opening end of the mouth, the liner having an outer edge that is separated from the cylinder in an internal side and is formed to ensure a space between the outer edge and the cylinder, the outer-seal projection having an outer diameter smaller than an outer diameter of the opening end.

The invention provides a closing device including: a container capable of containing a beverage; and the above-described synthetic resin cap that is to be attached to a mouth thereof.

The invention provides a beverage-contained closing device including: a container which is filled with a beverage; and the above-described synthetic resin cap that is attached to a mouth thereof.

Effects of the Invention

According to the invention, since the outer edge of the liner is formed and spaced apart from the cylinder in the internal side, the outer-seal projection is formed at the position separated from the cylinder in an internal direction, and a space is ensured at the outside of the outer-seal projection.

Because of this, when a force is applied to the outer-seal projection in radial-outer direction, the space is utilized, and the outer-seal projection can be easily deformed outward.

Therefore, when the cap is attached to the mouth, the outer-seal projection deforms outward and covers at least part of the outer edge of the opening end.

Since the outer diameter of the outer-seal projection is smaller than the outer diameter of the opening end, the outer-seal projection comes into contact with the outer edge of the opening end in a state of being pressed by the opening end and being deformed outward, an elastic repulsion force acts, and the outer-seal projection is always in contact with the outer edge by an adequate push pressure.

Accordingly, reliable tight sealing is possible.

Furthermore, since the outer-seal projection can be deformed outward, even in a case where the outer diameter of the mouth varies (particularly, in the case where the outer diameter is larger than the designed value), the outer-seal projection is shaped depending on the opening end and reliably comes into contact with the opening end by an adequate push pressure.

Consequently, even in a case where the outer diameter of the mouth varies, reliable tight sealing is possible.

Additionally, not only the outer-seal projection of the liner but also the inter-seal projection thereof comes into contact with the opening end, reliable tight sealing is possible, it is possible to increase pressure resistance.

Moreover, in addition to that the liner comes into contact with the opening end by an adequate pressing force which is due to deformation of the outer-seal projection, since the liner is in contact with the opening end at a plurality of points thereof, it is possible to make each of push pressures of the points lower.

Since an excessive force is not locally applied to the opening end, it is possible to prevent the mouth from being deformed even under a condition of a high temperature.

Furthermore, since an excessive force is not locally applied to the opening end in the cap, it is possible to reduce a disconnecting torque, and therefore, it is advantageous in terms of ease of disconnecting.

Moreover, since a pressing force does not locally increase, it is possible to prevent the generation of broken shards which is due to a crushed part of the liner.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Figure 1:
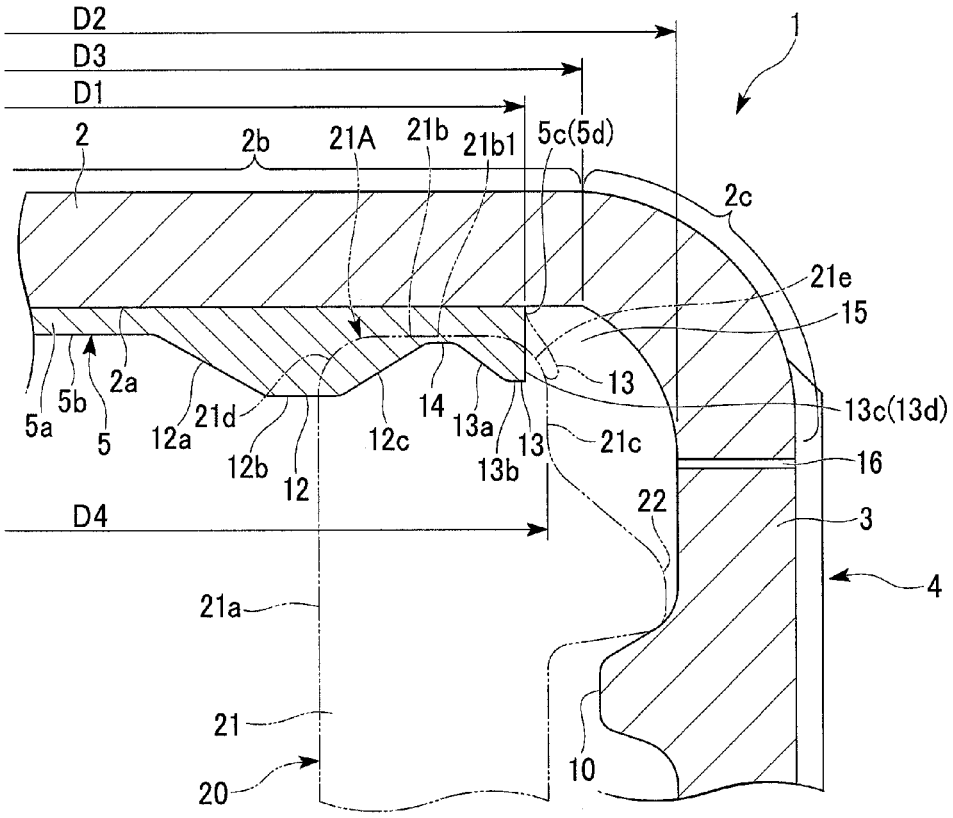
FIG. 1 is a cross-sectional view showing part of a synthetic resin cap according to one embodiment of the invention.
Figure 2:
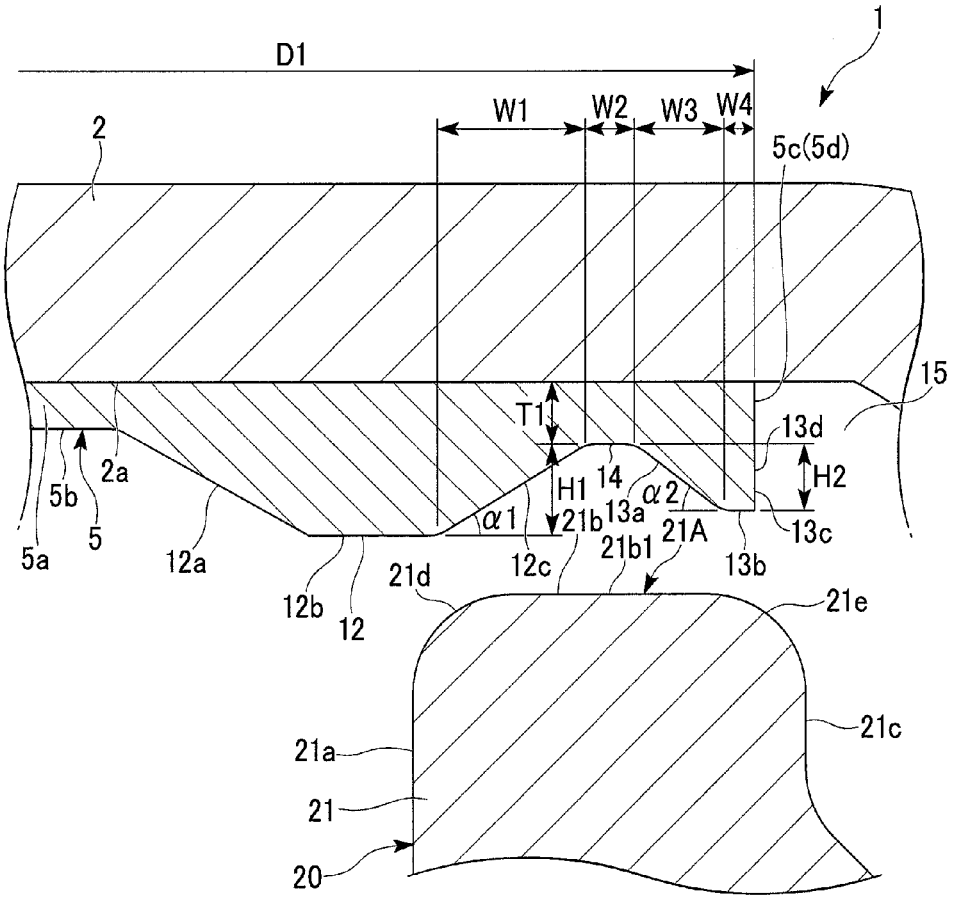
FIG. 2 is a cross-sectional view showing part of a liner of the synthetic resin cap shown in FIG. 1.
Figure 3:
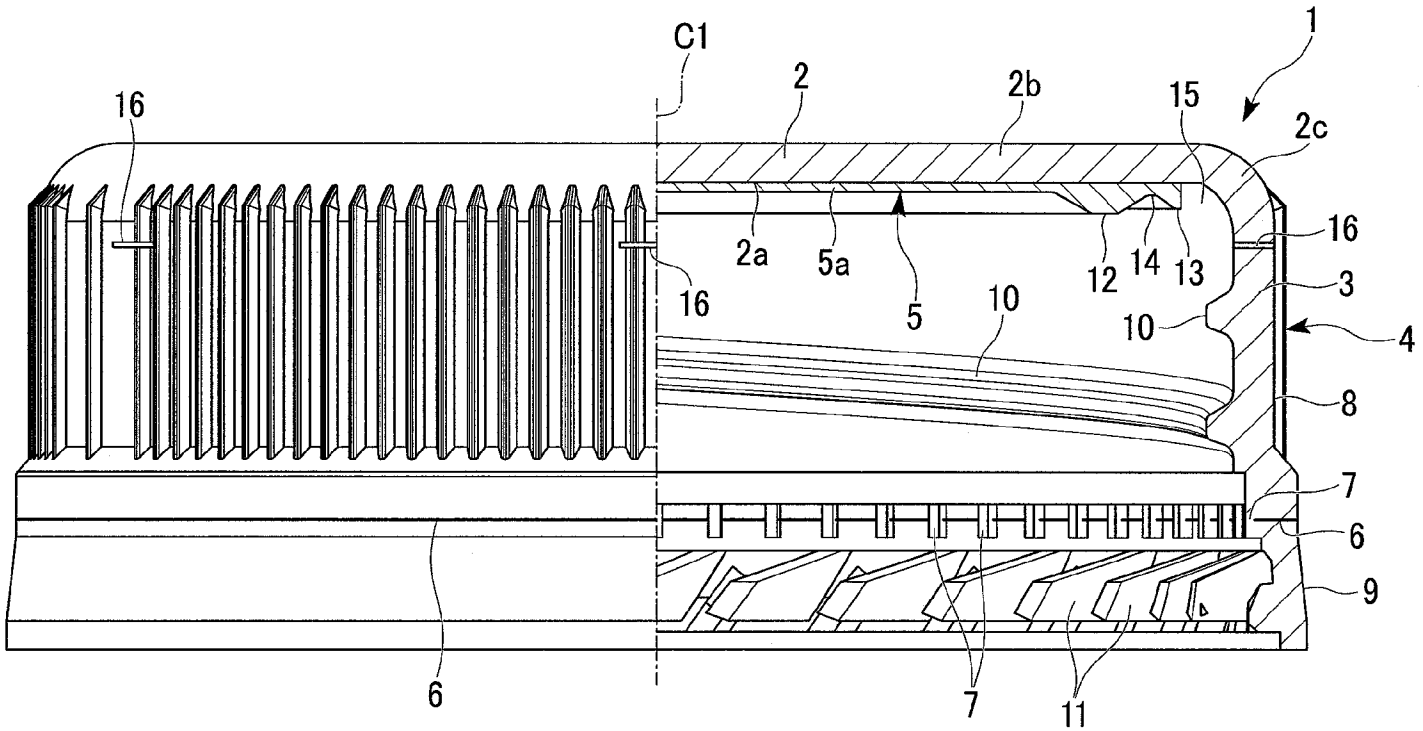
FIG. 3 is a cross-sectional view showing the entire synthetic resin cap shown in FIG. 1.

FIGS. 1 to 3 shows a synthetic resin cap according to one embodiment of the invention and a closing device using this, and the closing device shown here is configured by a container 20 and a synthetic resin cap 1 (hereinbelow, simply referred to as a cap 1) that is attached to a mouth 21 thereof.

In FIG. 3, reference numeral C1 represents the central axis of the cap 1.

In the explanation described below, a vertical direction and a height direction mean downward and upward direction shown in FIGS. 1 to 3 and mean the direction along the central axis C1.

As shown in FIGS. 1 and 2, the container 20 is made of, for example, a synthetic resin material such as polyethylene terephthalate (PET), and includes a container body capable of being filled with a beverage (not shown in the figure) and a cylindrical mouth 21 that is formed at the upper portion thereof.

A male screw 22 is formed on an outer face 21*c* of the mouth 21.

An engagement step portion (not shown in the figure) serving as a ring-shaped protrusion protruding in a radial-outer direction is formed on the outer face 21*c*.

The inner surface 21*a* and the outer face 21*c* of the mouth 21 are surfaces along the axial direction of the container 20.

An opening edge surface 21*b* of the opening end 21A is a surface vertical to the axial direction of the container 20.

The portion that is from an inner edge of the opening edge surface 21*b* to an upper edge of the inner surface 21*a* is an inner-edge curved portion 21*d* (inner edge) having a substantially circular are cross-section, and the portion that is from an outer edge of the opening edge surface 21*b* to an upper edge of the outer face 21*c* is an outer-edge curved portion 21*e* (outer edge) having a substantially circular arc cross-section.

The opening end 21A includes the inner-edge curved portion 21*d*, the opening edge surface 21*b*, and the outer-edge curved portion 21*e*.

In order to ensure transparency, it is preferable that the mouth 21 be amorphous.

It is preferable that the mouth 21 have a light transmittance of, for example, 50% or more of visible light in the wall thickness direction.

In other cases, the mouth 21 may be crystallized by heating or the like.

As shown in FIG. 3, the cap 1 is provided with: the cap body 4 having a disk-shaped top plate 2 and a cylinder 3 that is vertically lowered from the peripheral edge thereof; and a substantially disk-shaped liner 5 (synthetic resin cap liner) provided on the lower surface 2*a* of the top plate 2.

As shown in FIG. 1, the top plate 2 has a plate-shaped main portion 2*b* and an outer-edge curved portion 2*c* that is formed at a peripheral edge thereof and has a substantially circular arc cross-section.

The outer-edge curved portion 2*c* is a curve portion that is formed to extend from the outer edge of the main portion 2*b* to the upper edge of the cylinder 3.

The outer-edge curved portion 2*c* is formed in a curved shape that gradually lowers according to the direction in which the diameter thereof increases.

As shown in FIG. 3, the cylinder 3 is partitioned into a main portion 8 and a tamper evidence ring portion (TE ring portion) 9 by a score 6 (weakened portion), and the tamper evidence ring portion is coupled to the main portion 8 via a bridge 7.

A thread 10 that is to be threadably fitted into the male screw 22 of the container 20 is formed on the inner surface of the main portion 8.

The thread 10 is one or a plurality of spiral-shaped protuberances.

A cleaning-water introduction hole 16 for introducing a cleaning water into the inside of the cap 1 (the cap body 4) is formed at the upper portion of the cylinder 3.

The cleaning-water introduction hole 16 introduces a cleaning water to the inside of the cap 1 and is communicated with a space (outer space 15) between the outer edges 5*c* and 13*d* and the cylinder 3.

That is, the opening of the cleaning-water introduction hole 16 at the inner surface of the cylinder 3 is located at the position to which the space (space between the cap 1 and the mouth 21) in communication with the outer space 15 is exposed.

The cleaning-water introduction hole 16 preferably has a slit shape extending in the circumferential direction of the cap 1.

The length of the cleaning-water introduction hole 16 in the circumferential direction may be, for example, 0.5 to 5 mm.

The maximum width of the cleaning-water introduction hole 16 (the length in the vertical direction thereof) may be, for example, 0.01 to 0.1 mm.

It is preferable that the cleaning-water introduction hole 16 be formed at the position higher than the upper end of the thread 10.

The cleaning-water introduction hole 16 shown as an example in the drawing is located lower than the opening edge surface 21*b*.

The outer diameter of the cap body 4 is not particularly limited and may be 30 mm or more (for example, greater than or equal to 35 mm).

As shown in FIGS. 1 and 2, the liner 5 includes: a disk-shaped flat plate 5*a* provided on the lower surface 2*a* of the top plate 2; a ring-shaped inter-seal projection 12 that protrudes downward from the lower surface 5*b* of the flat plate 5*a*; a ring-shaped outer-seal projection 13 that protrudes downward from the lower surface 5*b* of the flat plate 5*a*; and an intermediate contact portion 14 that is located between such two seal projections 12 and 13 and is configured to contact the opening edge surface 21*b*.

The flat plate 5*a* is formed in a plate shape, the edge surface 5*d* of the outer edge 5*c* is formed vertical to the lower surface 2*a* (in the direction along the central axis C1 of the cap 1).

The inter-seal projection 12 is a protrusion that contacts the inner-edge side of the opening end 21A and has a portion of the outer face 12*c* which contacts at least the opening end 21A, and the portion is formed in a shape of an inclined surface that is inclined so as to rise up according to the direction in which the diameter thereof gradually increases.

The inter-seal projection 12 shown as an example in the drawing has a substantially trapezoidal cross-sectional shape in which the width thereof is gradually less in the protruding direction.

The inter-seal projection 12 includes: a linearly-inclined inner surface 12*a* that lowers according to the direction in which the diameter thereof gradually increases; a lower surface 12*b* that is from the outer edge of the inner surface 12*a* and is formed parallel to the lower surface 2*a*; and the outer face 12*c* that is linearly inclined so as to rise up according to the direction in which the diameter thereof gradually increases.

It is preferable that the internal diameter of the lower surface 12*b* be smaller than the internal diameter of the mouth 21 (the internal diameter of the upper edge of the inner surface 21*a*) and that the outer diameter of the lower surface 12*b* be larger than the internal diameter of the mouth 21.

Particularly, the inner surface 12*a* is an inclined surface in the inter-seal projection 12 shown as an example in the drawing; however, the inner surface 12*a* may be a surface perpendicular to the lower surface 2*a* (the surface in the direction along the central axis C1 of the cap 1).

As shown in FIG. 2, the inclination angle $\alpha$1 of the outer face 12*c* (inclination angle with respect to the lower surface 2*a* of the top plate 2) may be, for example, 10 to 45°.

If the inclination angle of the outer face 12*c* is excessively small, degrees of the effect of preventing the mouth 21 from being deformed and the sealing performance become low. If the inclination angle is excessively large, ease in the tightening of the cap 1 is affected. However, as a result of setting the inclination angle $\alpha$1 in the above range, it is possible to obtain the effect of preventing the mouth 21 from being deformed and realize a reliable sealing performance of the cap 1 without degradation in the ease of tightening.

The width W1 of the outer face 12*c* in the radial direction thereof is preferably 0.5 to 2 mm.

If the width of the outer face 12*c* is excessively small, the ease of tightening is affected. If the width is excessively large, degrees of the effect of preventing the mouth 21 from being deformed and the sealing performance become low. However, as a result of setting the width W1 in the above range, it is possible to obtain the effect of preventing the mouth 21 from being deformed and realize a reliable sealing performance of the cap 1 without degradation in the ease of tightening.

The height H1 of the inter-seal projection 12 (height from the intermediate contact portion 14) is preferably 0.2 to 2 mm.

If the inter-seal projection 12 is excessively low, degrees of the effect of preventing the mouth 21 from being deformed and the sealing performance become low. If the inter-seal projection is excessively high, ease in the tightening of the cap 1 is affected. However, as a result of setting the height H1 in the above range, it is possible to obtain the effect of preventing the mouth 21 from being deformed and realize a reliable sealing performance of the cap 1 without degradation in the ease of tightening.

Figure 4:
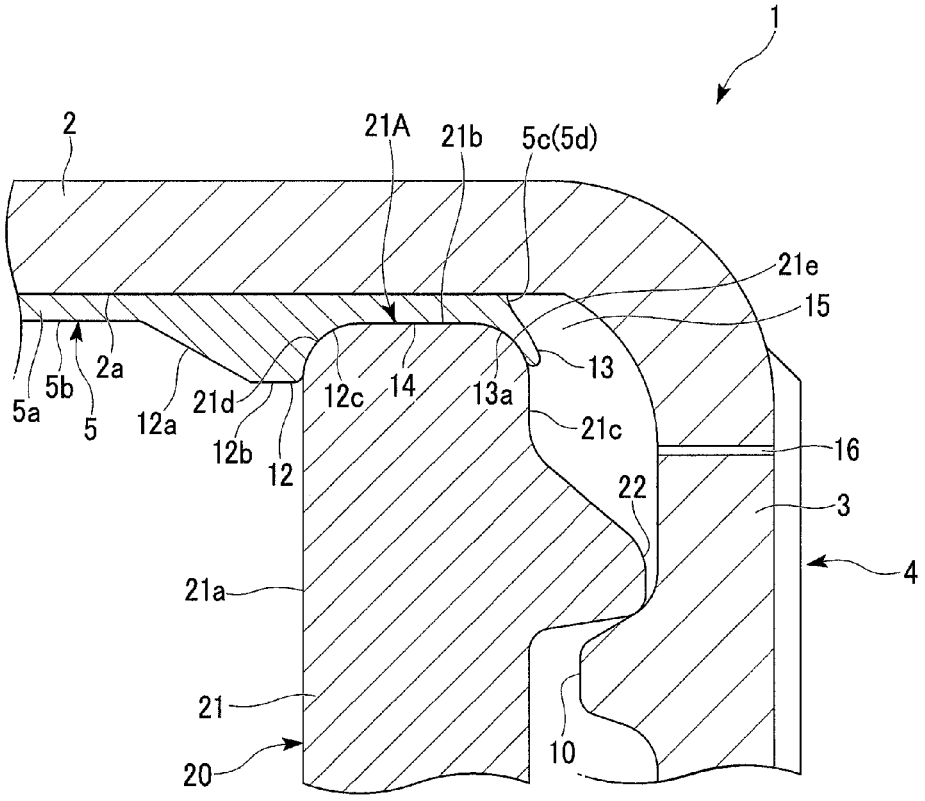
FIG. 4 is a cross-sectional view illustrating a state where the synthetic resin cap shown in FIG. 1 is attached to a container mouth.
Figure 5:
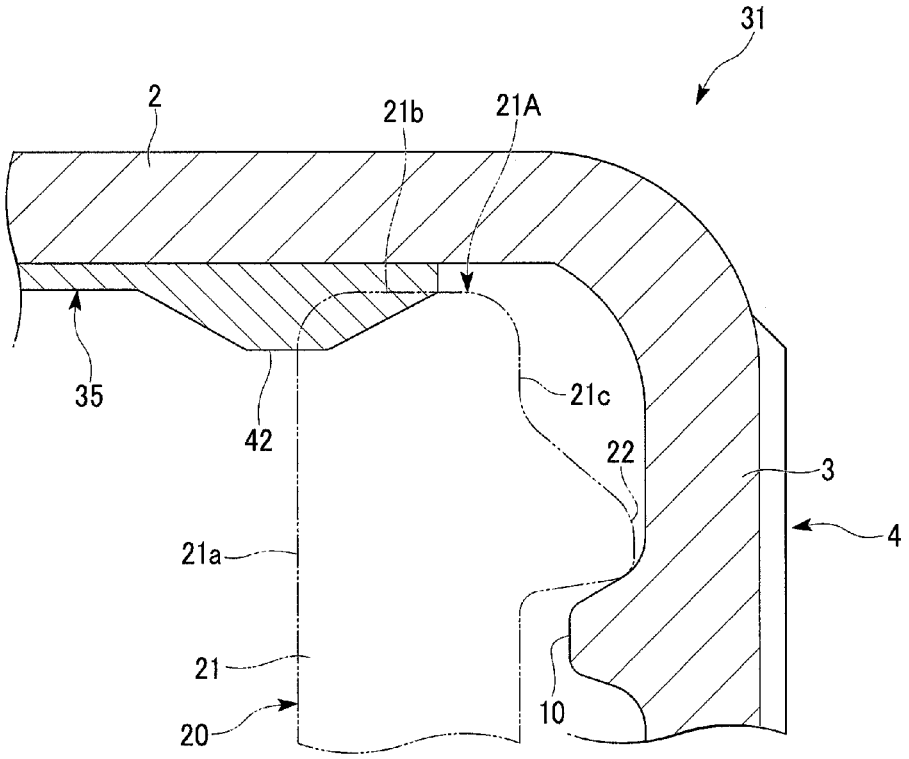
FIG. 5 is a cross-sectional view showing part of a synthetic resin cap as an example.
Figure 6:
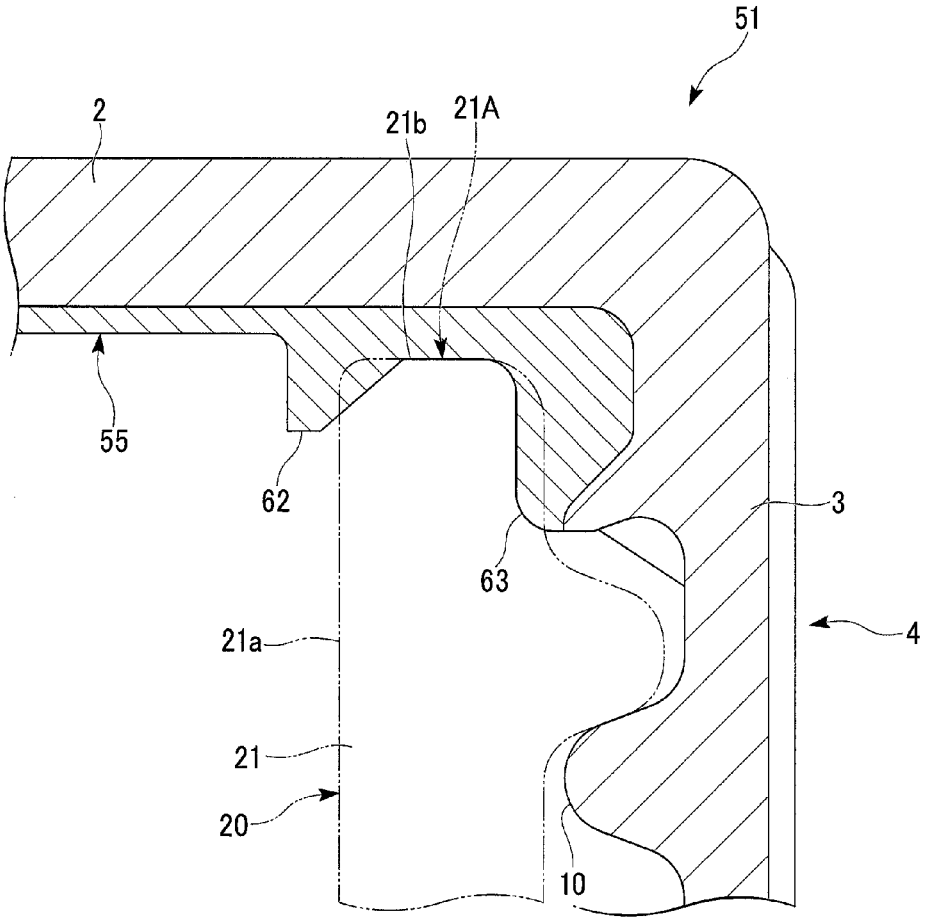
FIG. 6 is a cross-sectional view showing part of a synthetic resin cap as another example.

FIG. 4 is a view showing the cap 1 in a state of being attached to the mouth 21.

As shown in FIGS. 1 and 4, the outer face 12*c* of the inter-seal projection 12 is mainly in contact with the inner-edge curved portion 21*d* of the opening end 21A.

Particularly, in a state where the inter-seal projection 12 is compressively deformed in the thickness direction thereof, the outer face 12*c* is in contact with the inner-edge curved portion 21*d* and a region of part of the opening edge surface 21*b*.

The outer face 12*c* comes into contact with the inner-edge curved portion 21*d* and a region of part of the opening edge surface 21*b* in a state of being pressed by an elastic repulsion force.

The pressing force generated from the outer face 12*c* includes a direction component in which the diameter gradually increases in the downward direction (diagonally downward right direction in FIG. 1).

As shown in FIG. 3, it is preferable that the outer-seal projection 13 be formed at the position that is located separately from the inter-seal projection 12 in the radial-outer direction.

The outer-seal projection 13 shown as an example in the drawing is formed at a distance from the inter-seal projection 12 with the intermediate contact portion 14 interposed therebetween.

The intermediate contact portion 14 is a circular ring-shaped region that is formed so as to have a predetermined width and is formed thicker than the flat plate 5*a*.

The intermediate contact portion 14 can be formed along the lower surface 2*a*.

It is preferable that the intermediate contact portion 14 be formed in contact with the region including a center position 21*b*1 of the opening edge surface 21*b*.

The width W2 of the intermediate contact portion 14 is preferably 0.1 to 1 mm.

If the width of the intermediate contact portion 14 is excessively small, the sealing performance becomes low. If the width is excessively large, there is a possibility that the effect of preventing the mouth 21 from being deformed is affected. However, as a result of setting the width W2 in the above range, a pressing force from the intermediate contact portion 14 to the opening edge surface 21*b* becomes sufficient to provide an excellent sealing performance to the cap 1, and it is possible to increase a degree of the effect of preventing the mouth 21 from being deformed.

The thickness T1 of the intermediate contact portion 14 is preferably 0.2 to 2 mm.

If the thickness of the intermediate contact portion 14 is excessively thin, there is a concern that the sealing performance becomes low or the deformation of the mouth 21 is likely to occur. If the thickness is excessively thick, there is a possibility that the effect of preventing the mouth 21 from being deformed is affected. However, as a result of setting the thickness T1 in the above range, a pressing force from the intermediate contact portion 14 to the opening edge surface 21*b* becomes sufficient to provide an excellent sealing performance to the cap 1, and it is possible to increase a degree of the effect of preventing the mouth 21 from being deformed.

As shown in FIGS. 1 and 4, the intermediate contact portion 14 mainly comes into contact with the opening edge surface 21*b* of the mouth 21, particularly, is in contact with a region of part of the opening edge surface 21*b* in a state of being compressively deformed in the thickness direction.

The intermediate contact portion 14 is in contact with the opening edge surface 21*b* in a state of being pressed by an elastic repulsion force in the downward direction.

In other cases, the liner 5 may have a configuration in which the intermediate contact portion 14 is not provided, that is, a configuration in which the outer-seal projection 13 is formed close to the outside of the inter-seal projection 12.

The outer-seal projection 13 is a protrusion that contacts the outer-edge side of the opening end 21A and has a portion of the inner surface 13*a* which contacts at least the opening end 21A, the portion is formed in a shape of an inclined surface that lowers according to the direction in which the diameter thereof gradually increases.

The outer-seal projection 13 shown as an example in the drawing has a substantially trapezoidal cross-sectional shape in which the width thereof is gradually less in the protruding direction.

The outer-seal projection 13 includes: a linearly-inclined inner surface 13*a* that lowers according to the direction in which the diameter thereof gradually increases; a lower surface 13*b* that is from the outer edge of the inner surface 13*a* and is formed parallel to the lower surface 2*a*; and an outer face 13*c* that is vertical to the lower surface 2*a*.

As shown in FIG. 3, the inclination angle $\alpha$2 of the inner surface 13*a* (inclination angle with respect to the lower surface 2*a* of the top plate 2) may be, for example, 10 to 45°.

If the inclination angle of the inner surface 13*a* is excessively small, degrees of the effect of preventing the mouth 21 from being deformed and the sealing performance become low. If the inclination angle is excessively large, ease in the tightening of the cap 1 is affected. However, as a result of setting the inclination angle $\alpha$2 in the above range, it is possible to obtain the effect of preventing the mouth 21 from being deformed and realize a reliable sealing performance of the cap 1 without degradation in the ease of tightening.

The width W3 of the inner surface 13*a* in the radial direction is preferably 0.5 to 2 mm.

If the width of the inner surface 13*a* is excessively small, the ease of tightening is affected. If the width is excessively large, degrees of the effect of preventing the mouth 21 from being deformed and the sealing performance become low. However, as a result of setting the width W2 in the above range, it is possible to obtain the effect of preventing the mouth 21 from being deformed and realize a reliable sealing performance of the cap 1 without degradation in the ease of tightening.

As shown in FIGS. 1 and 4, the inner surface 13*a* of the outer-seal projection 13 is mainly in contact with the outer-edge curved portion 21*e* of the opening end 21A.

Particularly, in a state where the outer-seal projection 13 is compressively deformed in the thickness direction thereof, the inner surface 13*a* is in contact with the outer-edge curved portion 21*e* and a region of part of the opening edge surface 21*b*.

The inner surface 13*a* comes into contact with the outer-edge curved portion 21*e* and a region of part of the opening edge surface 21*b* in a state of being pressed by an elastic repulsion force.

The pressing force generated from the inner surface 13*a* includes a direction component in which the diameter gradually decreases in the downward direction (diagonally downward left direction in FIG. 1).

The width W4 of the lower surface 13*b* in the radial direction thereof is preferably 0.1 to 0.5 mm.

If the width of the lower surface 13*b* is excessively small or excessively large, the effect of preventing the mouth 21 from being deformed and the sealing performance are affected; however, as a result of setting the width W3 in the above range, it is possible to obtain the effect of preventing the mouth 21 from being deformed and realize a reliable sealing performance of the cap 1.

In an example in the drawing, the outer face 13*c* of the outer-seal projection 13 is formed vertical to the lower surface 2*a* (in the direction along the central axis C1 of the cap 1).

It is preferable that the outer face 13*c* be formed on the same plane as the edge surface 5*d* of the outer edge 5*c* of the flat plate 5*a*.

In other cases, the outer face 13*c* may be an inclined surface that is inclined so as to rise up or lower according to the direction in which the diameter thereof gradually increases.

The height H2 of the outer-seal projection 13 (height from the intermediate contact portion 14) is preferably 0.2 to 2 mm.

If the outer-seal projection 13 is excessively low, degrees of the effect of preventing the mouth 21 from being deformed and the sealing performance become low. If the outer-seal projection is excessively high, ease in the tightening of the cap 1 is affected. However, as a result of setting the height H2 in the above range, it is possible to obtain the effect of preventing the mouth 21 from being deformed and realize a reliable sealing performance of the cap 1 without degradation in the ease of tightening.

The outer-seal projection 13 shown as an example in the drawing is formed lower than the inter-seal projection 12.

In other cases, the outer-seal projection 13 may have the same height as that of the inter-seal projection 12 or may be formed higher than the inter-seal projection 12.

The outer edge 13*d* of the outer-seal projection 13 shown as an example in the drawing reaches the outer edge 5*c* of the flat plate 5*a*.

That is, the outer-seal projection 13 is formed at the outermost position of the liner 5, and the outer diameter of the outer-seal projection 13 is equal to the outer diameter of the flat plate 5*a*.

As a result of forming the outer-seal projection 13 at the outermost position of the liner 5, the outer-seal projection 13 is easily deformed outward.

In other cases, the outer-seal projection 13 may be formed closer to the inside than the outer edge 5*c* of the flat plate 5*a*.

The outer diameter of the liner 5 (the outer diameter of the flat plate 5*a* and the outer diameter of the outer-seal projection 13, the outer diameter D1 in FIG. 1) is smaller than the internal diameter of the cylinder 3 (the internal diameter D2 in FIG. 1).

Consequently, the outer edges 5*c* and 13*d* of the liner 5 does not reach the cylinder 3.

In particular, the outer edges 5*c* and 13*d* of the flat plate 5*a* and the outer-seal projection 13 are formed to be spaced apart from the cylinder 3 in the internal side and are formed to ensure a space between the cylinder 3 and the outer edges.

The space between the outer edges 5*c* and 13*d* of the liner and the cylinder 3 is referred to as the outer space 15.

The distance between the outer edges 5*c* and 13*d* to the cylinder 3 may be, for example, 0.1 to 2 mm.

The outer diameter D1 of the liner 5 is preferably smaller than the internal diameter (internal diameter D3) of the main portion 2*b* of the top plate 2.

The outer diameter D1 of the outer-seal projection 13 is smaller than the outer diameter (the outer diameter at the upper edge of the outer face 21*c*, the outer diameter D4 in FIG. 1) of the opening end 21A.

The liner 5 is made of a resin softer than the cap body 4, and for example, a resin composition containing polypropylene resins or polyethylene resins and thermoplastic elastomer can be used.

The surface hardness (durometer D, in conformity to JIS K 7215) of the liner 5 is preferably 20 to 65.

Locking protuberances 11 are formed on an inner peripheral face of the TE ring portion 9 and serve as locking protrusions that are to be engaged with an engagement step portion 23 of the container 20 and prevent movement of the TE ring portion 9 during disconnecting.

The locking protuberances 11 are formed to protrude inward from the inner peripheral face of the TE ring portion 9.

The cap 1 can be made of a synthetic resin material such as polypropylene or high density polyethylene.

Particularly, in the case of using polypropylene, a high degree of transparency can be imparted to the cap body 4 and is, therefore, preferable.

When the cap 1 attached to the mouth 21 rotates in a disconnecting direction, the cap 1 moves upward in accordance with rotation.

In a state where the locking protuberances 11 reaches a lower end of an engagement step portion (not shown in the figure) of the container 20, when the cap 1 further rotates in the disconnecting direction, the main portion 8 moves upward in accordance with rotation; in contrast to this, since the locking protuberances 11 is engaged with the engagement step portion, upward movement of the TE ring portion 9 is prevented.

As a result, a tension acts on the bridge 7 that couples the main portion 8 to the TE ring portion 9, the bridge 7 is fractured, and the TE ring portion 9 is separated off from the main portion 8.

For this reason, the cap 1 is clearly disconnected.

For rinsing the outer face of the mouth 21 attached to the cap 1, a cleaning water is provided on the outer face of the cap 1.

The cleaning water is introduced into the inside of the cap 1 through the cleaning-water introduction hole 16, flows downward through the outer face 21*c*, and flows out from the cap 1. In this way, the mouth 21 is cleaned.

As described above, since the outer edges 5*c* and 13*d* of the liner 5 do not reach the cylinder 3, the cleaning water also flows into a space (outer space 15) between the outer edges 5*c* and 13*d* and the cylinder 3.

Accordingly, the outer face 21*c* of the opening end 21A and the position close to the opening edge surface 21*b* can be cleaned.

In the cap 1, since the outer edge 5*c* of the liner 5 is formed separated from the cylinder 3 in the internal side, the outer-seal projection 13 is formed at the position apart from the cylinder 3 in the internal direction, and the space (the outer space 15) is ensured in the outside of the outer-seal projection 13.

For this reason, when a force in the radial-outer direction is applied to the outer-seal projection 13, the outer-seal projection can be easily deformed outward while utilizing the outer space 15.

For example, outward deformation indicated by the dashed-two dotted line shown in FIG. 1 is possible.

Accordingly, when the cap 1 is attached to the mouth 21, the outer-seal projection 13 is deformed outward and covers at least part of the outer-edge curved portion 21*e*.

Since the outer diameter of the outer-seal projection 13 is smaller than the outer diameter of the opening end 21A, the outer-seal projection 13 comes into contact with the outer-edge curved portion 21*e* of the opening end 21A in a state of being pressed by the opening end 21A and thereby being elastically deformed outward, therefore, an elastic repulsion force acts, and the outer-seal projection is always in contact with the outer-edge curved portion 21*e* by an adequate pressing force.

Accordingly, reliable tight sealing is possible.

Since this elastic repulsion force is an elastic force in the restoring direction to original state from the state where the outer-seal projection 13 is deformed outward, it is difficult for this force to be excessively large as compared with the repulsion force generated from a simple compression state.

Additionally, since the outer-seal projection 13 can be deformed outward, even in a case where the outer diameter of the mouth 21 varies (particularly, in the case where the outer diameter is larger than the designed value), the outer-seal projection 13 is shaped depending on the opening end 21A and comes into contact with the outer-edge curved portion 21*e* by an adequate push pressure.

Consequently, even in a case where the outer diameter of the mouth 21 varies, reliable tight sealing is possible.

In the deformed state indicated by the dashed-two dotted line shown in FIG. 1, not only the outer-seal projection 13 of the liner 5 (the portion located lower than the intermediate contact portion 14) but also the portion (the flat plate 5*a*) located higher than the intermediate contact portion 14 are deformed outward.

Since the inter-seal projection 12 and the intermediate contact portion 14 of the liner 5 comes into contact with the opening end 21A, a plurality of portions of the liner 5, specifically, three portions of the inter-seal projection 12, the intermediate contact portion 14 and the outer-seal projection 13 mainly press the inner-edge curved portion 21*d*, the opening edge surface 21*b*, and the outer-edge curved portion 21*e* of the opening end 21A in the cap 1, respectively, and therefore reliable tight sealing is possible.

Accordingly, it is possible to increase pressure resistance.

Pressure resistance can be evaluated by, for example, secure seal test (SST).

In the cap 1, since the liner 5 comes into contact with the opening end 21A at a plurality of portions (the three points) in addition to that the outer-seal projection 13 comes into contact with the opening end 21A by an appropriate pressing force due to the deformation thereof, it is possible to make the pressing force at each of the portions lower.

Since an excessive force is not locally applied to the opening end 21A, it is possible to prevent the mouth 21 from being deformed even under a condition of a high temperature in which the mechanical strength of the mouth 21 is degraded.

Since the mouth 21 is less easily deformed, the cap 1 is preferable in the case of using a container 20 that is provided with the mouth 21 made of amorphous having a relatively low strength.

Since an excessive force is not locally applied to the opening end 21A in the cap 1, it is possible to reduce a disconnecting torque, and therefore, it is advantageous in terms of ease of disconnecting.

Moreover, since the pressing force of the liner 5 does not locally increase, it is possible to prevent the generation of broken shards which is due to a crushed part of the liner 5.

Furthermore, since the liner 5 in the cap 1 tightly seals the opening end 21A at a plurality of portions, particularly, three portions of the inter-seal projection 12, the intermediate contact portion 14, and the outer-seal projection 13, the rotation angle of the cap 1 from the closed position to the release of sealing (seal release angle; S.R.A.) can be increased, and an excellent tamper evidence property is provided.

The closing device shown in FIG. 1 or the like can realize a beverage-contained closing device as a result of filling the container 20 with a beverage and attaching the cap 1 to the mouth 21.

In the cap 1 shown in FIG. 1, the inter-seal projection 12 has a substantially trapezoidal cross-sectional shape in which the width thereof is gradually less in the protruding direction, however, a triangle cross-sectional shape may be adopted.

As an example, the inter-seal projection 12 may have a triangle cross-sectional shape such that the inner surface 12*a* and the outer face 12*c* extend toward the protruding end shown in FIG. 1, that is, a triangle cross-sectional shape having: the inner surface 12*a* serving as an inclined surface that gradually lowers according to the direction in which the diameter thereof increases; and the outer face 12*c* serving as an inclined surface that is adjacent thereto and gradually rises up according to the direction in which the diameter thereof increases.

Moreover, the configuration of the outer-seal projection 13 is not limited to a substantially trapezoidal cross-sectional shape in which the width thereof is gradually less in the protruding direction, a triangle cross-sectional shape may be adopted.

As an example, the outer-seal projection 13 may have a triangle cross-sectional shape such that the inner surface 13*a* and the outer face 13*c* extend toward the protruding end shown in FIG. 1, that is, a triangle cross-sectional shape having: the inner surface 13*a* serving as an inclined surface that gradually lowers according to the direction in which the diameter thereof increases; and the outer face 13*c* that is adjacent thereto and located along the central axis C1.

The liner 5 may has a structure tightly sealing the opening end 21A at two portions of the inter-seal projection 12 and the outer-seal projection 13.

The invention claimed is:

1. A synthetic resin cap comprising:

a cap body having a top plate and a cylinder that is vertically lowered from a peripheral edge thereof; and a liner provided on a lower surface of the top plate, the liner comprising:

a flat plate;

an inter-seal projection that is formed on a lower surface of the liner, said inter-seal projection having a lower surface parallel to the lower surface of the top plate and having an outer face, which is an inclined surface whose diameter increases as the outer face extends toward the top plate, the lower surface of the inter-seal projection being connected to the outer face;

an outer-seal projection that is formed on the lower surface of the liner, said outer-seal projection having a lower surface parallel to the lower surface of the top plate and having an inner face, which is an inclined surface whose diameter decreases as the inner face extends toward the top plate, the lower surface of the outer-seal projection being connected to the inner face; and an intermediate contact portion that is formed on the lower surface of the liner and has a surface extending parallel to the lower surface of the top plate, said intermediate contact portion being provided between one end of the outer face of the inter-seal projection and one end of the inner face of the outer-seal projection, the surface of the intermediate contact portion being directly connected to both the outer face and the inner face, wherein the liner has an outer edge that is spaced apart from the cylinder at an internal side and is formed to ensure a space between the outer edge and the cylinder, a width of the lower surface of the outer-seal projection is smaller than a width of the lower surface of the inter-seal projection, the outer face is inclined at an inclination angle of 10 to 45° with respect to the lower surface of the top plate, and the inner face is inclined at an inclination angle of 10 to 45° with respect to the lower surface of the top plate.

2. The synthetic resin cap according to claim 1, wherein an outer edge of the outer-seal projection is formed to reach an outer edge of the flat plate.

3. The synthetic resin cap according to claim 2, wherein an outer face of the outer-seal projection is formed on the same plane as an edge surface of an outer edge of the flat plate.

4. The synthetic resin cap according to claim 1, wherein a cleaning-water introduction hole for introducing a cleaning water into the cap body is formed at the cylinder.

5. A liner provided on a lower surface of a top plate of a synthetic resin cap, the synthetic resin cap comprising a cap body having the top plate and a cylinder that is vertically lowered from a peripheral edge thereof, the liner comprising:

a flat plate;

an inter-seal projection that is formed on a lower surface of the liner, said inter-seal projection having a lower surface parallel to the lower surface of the top plate and having an outer face, which is an inclined surface whose diameter increases as the outer face extends toward the top plate, the lower surface of the inter-seal projection being connected to the outer face;

an outer-seal projection that is formed on the lower surface of the liner, said outer-seal projection having a lower surface parallel to the lower surface of the top plate and having an inner face, which is an inclined surface whose diameter decreases as the inner face extends toward the top plate, the lower surface of the outer-seal projection being connected to the inner face; and an intermediate contact portion that is formed on the lower surface of the liner and has a surface extending parallel to the lower surface of the top plate, said intermediate contact portion being provided between one end of the outer face of the inter-seal projection and one end of the inter face of the outer-seal projection, the surface of the intermediate contact portion being directly connected to both the inclined surface of the inter-seal projection and the inclined surface of the outer-seal projection, wherein the liner has an outer edge that is spaced apart from the cylinder at an internal side and is formed to ensure a space between the outer edge and the cylinder, a width of the lower surface of the outer-seal projection is smaller than a width of the lower surface of the inter-seal projection, the outer face is inclined at an inclination angle of 10 to 45° with respect to the lower surface of the top plate, and the inner face is inclined at an inclination angle of 10 to 45° with respect to the lower surface of the top plate.

6. A closing device comprising:

a container capable of containing a beverage, said container having a mouth, the mouth having an opening end which includes an inner-edge curved portion, an opening edge surface, and an outer-edge curved portion; and a synthetic resin cap removably attached to the mouth of the container, the synthetic resin cap comprising:

a cap body having a top plate and a cylinder that is vertically lowered from a peripheral edge thereof, a liner provided on a lower surface of the top plate, the liner comprising, a flat plate, an inter-seal projection that is formed on a lower surface of the liner and has an outer face, an outer-seal projection that is formed on the lower surface of the liner and has an inner face, and an intermediate contact portion that is formed on the lower surface of the liner, wherein the liner has an outer edge that is spaced apart from the cylinder at an internal side and is formed to ensure a space between the outer edge and the cylinder, the outer-seal projection has an outer diameter smaller than an outer diameter of the mouth at the opening end when not in contact with the outer-edge curved portion, the inter-seal projection, the intermediate contact portion, and the outer-seal projection are pressed against the inner-edge curved portion, the opening edge surface, and the outer-edge curved portion, respectively, when the synthetic resin cap is attached to the mouth, the outer face of the inter-seal projection is an inclined surface whose diameter increases as the outer face extends toward the top plate, the inner face of the outer-seal projection is an inclined surface whose diameter decreases as the inner face extends toward the top plate, when the inter-seal projection is not in contact with the inner-edge curved portion, the inter-seal projection has a lower surface parallel to the lower surface of the top plate and the outer face of the inter-seal projection is an inclined surface whose diameter increases as the outer face extends toward the top plate, the lower surface of the inter-seal projection is connected to the outer face, when the outer-seal projection is not in contact with the outer-edge curved portion, the outer-seal projection has a lower surface parallel to the lower surface of the top plate and the inner face of the outer-seal projection is an inclined surface whose diameter decreases as the inner face extends toward the top plate, the lower surface of the outer-seal projection is connected to the inner face, when the intermediate contact portion is not in contact with the opening edge surface, the intermediate contact portion has a surface extending parallel to the lower surface of the top plate, the intermediate contact portion is provided between one end of the outer face of the inter-seal projection and one end of the inner face of the outer-seal projection, the surface of the intermediate contact portion is directly connected to both the outer face and the inner face, the outer face is inclined at an inclination angle of 10 to 45° with respect to the lower surface of the top plate when the inter-seal projection is not in contact with the inner-edge curved portion, and the inner face is inclined at an inclination angle of 10 to 45° with respect to the lower surface of the top plate when the inter-seal projection is not in contact with the inner-edge curved portion.

7. A beverage-container closing device comprising:

a container which is filled with a beverage, said having a mouth, the mouth having an opening end which has an inner-edge curved portion, an opening edge surface, and an outer-edge curved portion; and a synthetic resin cap removably attached to the mouth of the container, the synthetic resin cap comprising:

a cap body having a top plate and a cylinder that is vertically lowered from a peripheral edge thereof;

a liner provided on a lower surface of the top plate, the liner comprising;

a flat plate, an inter-seal projection that is formed on a lower surface of the liner and has an outer face, an outer-seal projection that is formed on the lower surface of the liner and has an inner face, and an intermediate contact portion that is formed on the lower surface of the liner, wherein the liner has an outer edge that is spaced apart from the cylinder at an internal side and is formed to ensure a space between the outer edge and the cylinder, the outer-seal projection has an outer diameter smaller than an outer diameter of the mouth at the opening end when not in contact with the outer-edge curved portion, the inter-seal projection, the intermediate contact portion, and the outer-seal projection are pressed against the inner-edge curved portion, the opening edge surface, and the outer-edge curved portion, respectively, when the synthetic resin cap is attached to the mouth, the outer face of the inter-seal projection is an inclined surface whose diameter increases as the outer face extends toward the top plate, the inner face of the outer-seal projection is an inclined surface whose diameter decreases as the inner face extends toward the top plate, when the inter-seal projection is not in contact with the inner-edge curved portion, the inter-seal projection has a lower surface parallel to the lower surface of the top plate and the outer face of the inter-seal projection is an inclined surface whose diameter increases as the outer face extends toward the top plate, the lower surface of the inter-seal projection is connected to the outer face, when the outer-seal projection is not in contact with the outer-edge curved portion, the outer-seal projection has a lower surface parallel to the lower surface of the top plate and the inner face of the outer-seal projection is an inclined surface whose diameter decreases as the inner face extends toward the top plate, the lower surface of the outer-seal projection is connected to the inner face, when the intermediate contact portion is not in contact with the opening edge surface, the intermediate contact portion has a surface extending parallel to the lower surface of the top plate, the intermediate contact portion is between one end of the outer face of the inter-seal projection and one end of the inner face of the outer-seal projection, the surface of the intermediate contact portion is directly connected to both the outer face and the inner face, the outer face is inclined at an inclination angle of 10 to 45° with respect to the lower surface of the top plate when the inter-seal projection is not in contact with the inner-edge curved portion, and the inner face is inclined at an inclination angle of 10 to 45° with respect to the lower surface of the top plate when the inter-seal projection is not in contact with the inner-edge curved portion.

8. The closing device according to claim 6, wherein the intermediate contact portion abuts the opening edge surface of the mouth when the synthetic resin cap is attached to the mouth.

9. The beverage-container closing device according to claim 7, wherein the intermediate contact portion abuts the opening edge surface of the mouth when the synthetic resin cap is attached to the mouth.

* * * * *